US007265497B2

(12) United States Patent
Chen et al.

(10) Patent No.: US 7,265,497 B2
(45) Date of Patent: Sep. 4, 2007

(54) METHODS AND PROTECTION SCHEMES FOR DRIVING DISCHARGE LAMPS IN LARGE PANEL APPLICATIONS

(75) Inventors: Wei Chen, Campbell, CA (US); James C. Moyer, San Jose, CA (US); Paul Ueunten, Los Gatos, CA (US)

(73) Assignee: Monolithic Power Systems, Inc., San Jose, CA (US)

( * ) Notice: Subject to any disclaimer, the term of this patent is extended or adjusted under 35 U.S.C. 154(b) by 0 days.

(21) Appl. No.: 11/250,161

(22) Filed: Oct. 13, 2005

(65) Prior Publication Data

US 2006/0076900 A1 Apr. 13, 2006

Related U.S. Application Data

(60) Provisional application No. 60/618,640, filed on Oct. 13, 2004.

(51) Int. Cl.
*H05B 39/04* (2006.01)

(52) U.S. Cl. ..... 315/209 R

(58) Field of Classification Search ..... 315/291, 315/307, 224, 70, 56–57, 149–150, 158, 315/177–178, 2, 209 R
See application file for complete search history.

(56) References Cited

U.S. PATENT DOCUMENTS

| | | | | |
|---|---|---|---|---|
| 6,118,415 | A * | 9/2000 | Olson | 345/41 |
| 6,396,722 | B2 * | 5/2002 | Lin | 363/98 |
| 6,501,234 | B2 * | 12/2002 | Lin et al. | 315/307 |
| 6,707,264 | B2 * | 3/2004 | Lin et al. | 315/307 |
| 6,804,129 | B2 * | 10/2004 | Lin | 363/98 |
| 6,870,330 | B2 * | 3/2005 | Choi | 315/307 |
| 6,979,959 | B2 * | 12/2005 | Henry | 315/291 |

* cited by examiner

*Primary Examiner*—Shih-Chao Chen
*Assistant Examiner*—Minh Dieu A
(74) *Attorney, Agent, or Firm*—Perkins Coie LLP; Zhou Lu

(57) ABSTRACT

The present disclosure introduces a simple method and apparatus for converting DC power to AC power for driving discharge lamps such as a cold cathode fluorescent lamp (CCFL), an external electrode fluorescent lamp (EEFL), or a flat fluorescent lamp (FFL). Among other advantages, the invention allows the proper protection under short circuit conditions for applications where the normal lamp current is greater than safe current limit.

20 Claims, 4 Drawing Sheets

METHODS AND PROTECTION SCHEMES FOR DRIVING DISCHARGE LAMPS IN LARGE PANEL APPLICATIONS

PRIORITY CLAIM

The present invention claims priority to U.S. Provisional Patent Application Ser. No. 60/618,640 filed Oct. 13, 2004.

TECHNICAL FIELD

The present invention relates to the driving of fluorescent lamps, and more particularly, to methods and protection schemes for driving cold cathode fluorescent lamps (CCFL), external electrode fluorescent lamps (EEFL), and flat fluorescent lamps (FFL).

BACKGROUND

In large panel displays (e.g., LCD televisions), many lamps are used in parallel to provide the bright backlight required for a high quality picture. The total current at full brightness can easily exceed the current limitations determined by governmental regulations. For example, the current limit as stated in Underwriters Laboratory (UL) standard UL60950 must not exceed 70 mA when the power inverter is shorted by a 2000 ohm impedance. However, the secondary side current in a typical 20-lamp backlight system may exceed that amount of current.

Traditional protection schemes measure the lamp currents, transformer primary current, or transformer current in general. Then, these currents are limited to below the maximum safe currents. However, this approach still has drawbacks.

DETAILED DESCRIPTION

The present invention relates to an apparatus and method for driving discharge lamps in large panel applications with overcurrent protection. The present invention can offer, among other advantages, a nearly symmetrical voltage waveform to drive discharge lamps, accurate control of lamp current to ensure good reliability, and protection schemes that limit circuit current under short circuit conditions.

Figure 1:
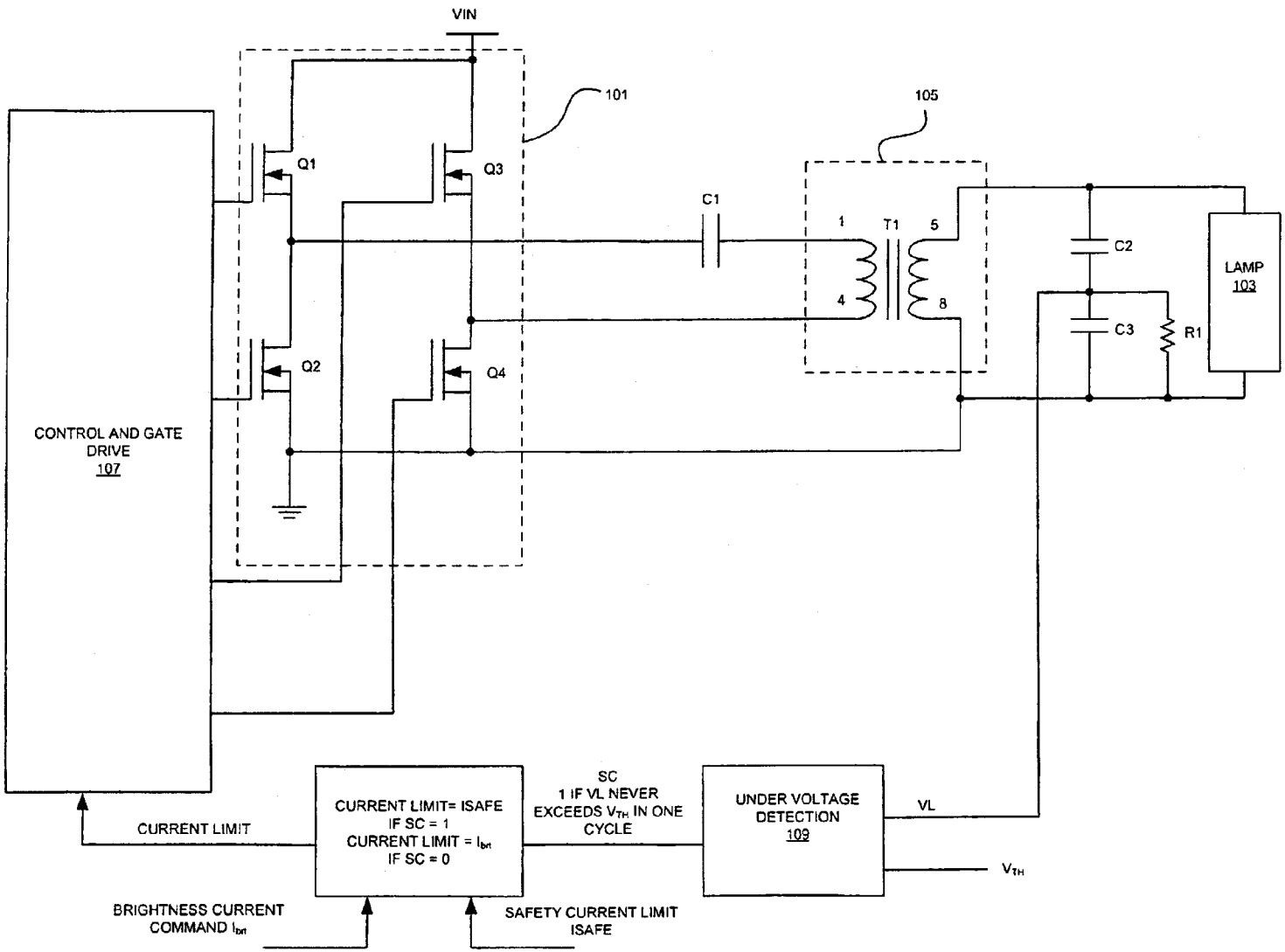
FIG. 1 is a schematic diagram showing a first embodiment of the present invention.

FIG. 1 shows a simplified schematic diagram of one embodiment of the present invention. In general, EEFL and FFL devices have higher impedance than CCFL devices because they use external electrodes. The intrinsic capacitance greatly increases the series impedance. The impedance of a lamp is typically between 120 Kohm and 800 Kohm Even with 30 lamps in parallel, the total impedance is still greater than 4 Kohm. As specified in UL60950, the impedance at short circuit is tested at 2 Kohm. Therefore, the present invention uses impedance as one way to differentiate the short circuit conditions from the normal operating conditions. There are several embodiments of the present invention described below.

Turning to FIG. 1, a full-bridge inverter circuit 101 is used to drive a lamp load 103 through a transformer 105. The lamp load 103 is shown as a single element, but is intended in some embodiments to represent multiple CCFLs, EEFLS, and/or FFLS. FIG. 1 also shows a control and gate driver circuit 107 which performs two main functions: (1) provide the appropriate control signals to the transistors of the full-bridge inverter 101 and (2) receive feedback to monitor various parameters.

The circuit of FIG. 1 monitors the AC amplitude of the transformer secondary side voltage as one of the parameters used in order to determine whether or not to initiate a protection protocol. The capacitors C1, C2, C3, the leakage inductance of transformer, and the magnetizing inductance of transformer (if it is small enough) forms a filter circuit that converts the square wave voltage generated by the full bridge inverter switches (Q1-Q4) into a substantially sinusoidal waveform input to the lamp load 103.

As noted above, the control and gate drive 107 generates the gate drive waveforms with appropriate duty cycle to regulate the lamp current to its reference current limit. The control section 107 also receives feedback on the lamp current (the current on the secondary side of the transformer 105). Capacitors C2 and C3 are also used as a voltage divider when sensing the transformer or lamp voltage. Resistor R1 is typically a very large resistor forcing a zero DC bias on a voltage feedback node.

Note that if the peak of the transformer voltage (the AC sine wave) on the secondary side (or load side) on node VL does not exceed a preset threshold $V_{TH}$ (for example, 40% of the normal operating voltage on node VL), this indicates a possible short circuit condition. A safety current threshold $I_{SAFE}$ is used as a current limit when there is a possible short circuit condition. The preset threshold $V_{TH}$ may also, for example, be set between 25 to 55 percent of the normal operating voltage.

In one embodiment, $I_{SAFE}$ is the RMS value $I_{RMS}$ of the normal operating current or the average rectified value $I_{RECT,AVG}$ ($I_{REC,AVG}=I_{RMS}*2*\text{sqrt}(2)/\pi$). Thus, an under-voltage detection block (such as a comparator) 109, which can be implemented using a myriad of circuits, is used to compare the voltage on node VL to $V_{TH}$. If VL is less than $V_{TH}$ for at least one switching cycle, the under-voltage detection block 109 will indicate the short circuit condition to a current limit selection block 111 and then choose the safety current $I_{SAFE}$ as the current limit. Otherwise, the under voltage detection block 109 will indicate to the current limit selection block 111 to choose the "normal" current limit, which in one embodiment is determined by an external brightness command level, $I_{BRT}$. However, it should be appreciated that the normal current limit in some embodiments is not limited to $I_{BRT}$, and instead may be set by other controllable parameters.

Note that if the negative AC amplitude of the transformer voltage never decreases below the preset threshold $V_{TH}$ (for example, 40% of the normal operating voltage), the short circuit protection current, preferably, RMS value $I_{RMS}$ or the average rectified value $I_{RECT,AVG}$, is smaller than the safety current $I_{SAFE}$.

Figure 2:
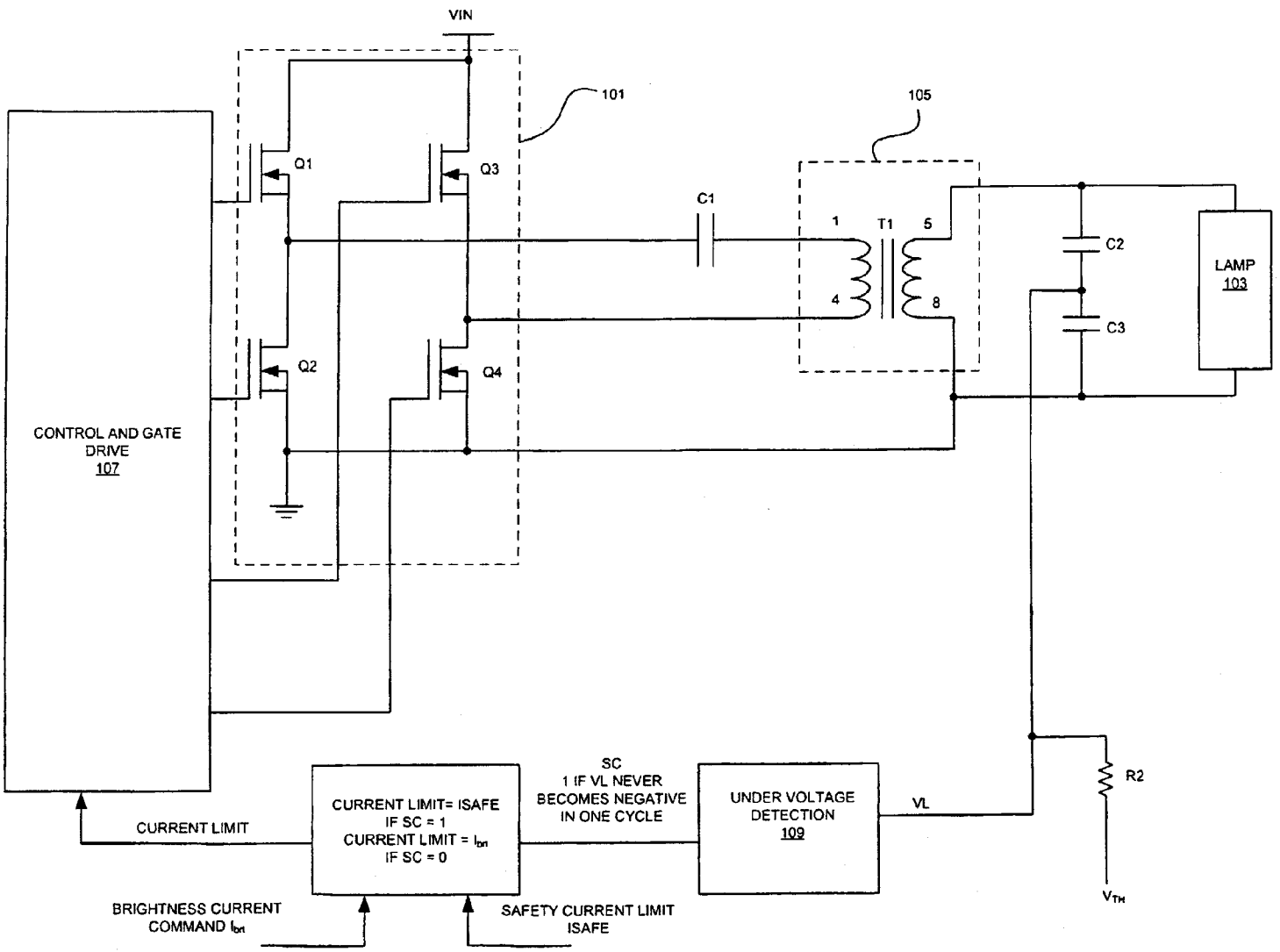
FIG. 2 is a schematic diagram showing a second embodiment of the present invention.

A variant implementation of FIG. 1 is shown in FIG. 2. In FIG. 2, resistor R2 biases VL to $V_{TH}$. Thus, if the input voltage to the under voltage detector 109 never drops below zero volts for at least one switching cycle, the AC amplitude of VL will be smaller than $V_{TH}$, indicating a short circuit condition.

In UL60950, the standard short circuit impedance of 2 kohm is much smaller than the lamp impedance for a CCFL, EEFL, or FFL. Therefore, the secondary or lamp current in a lamp application will be smaller than the current flowing through a 2 kohm load for the UL60950 test.

Figure 3:
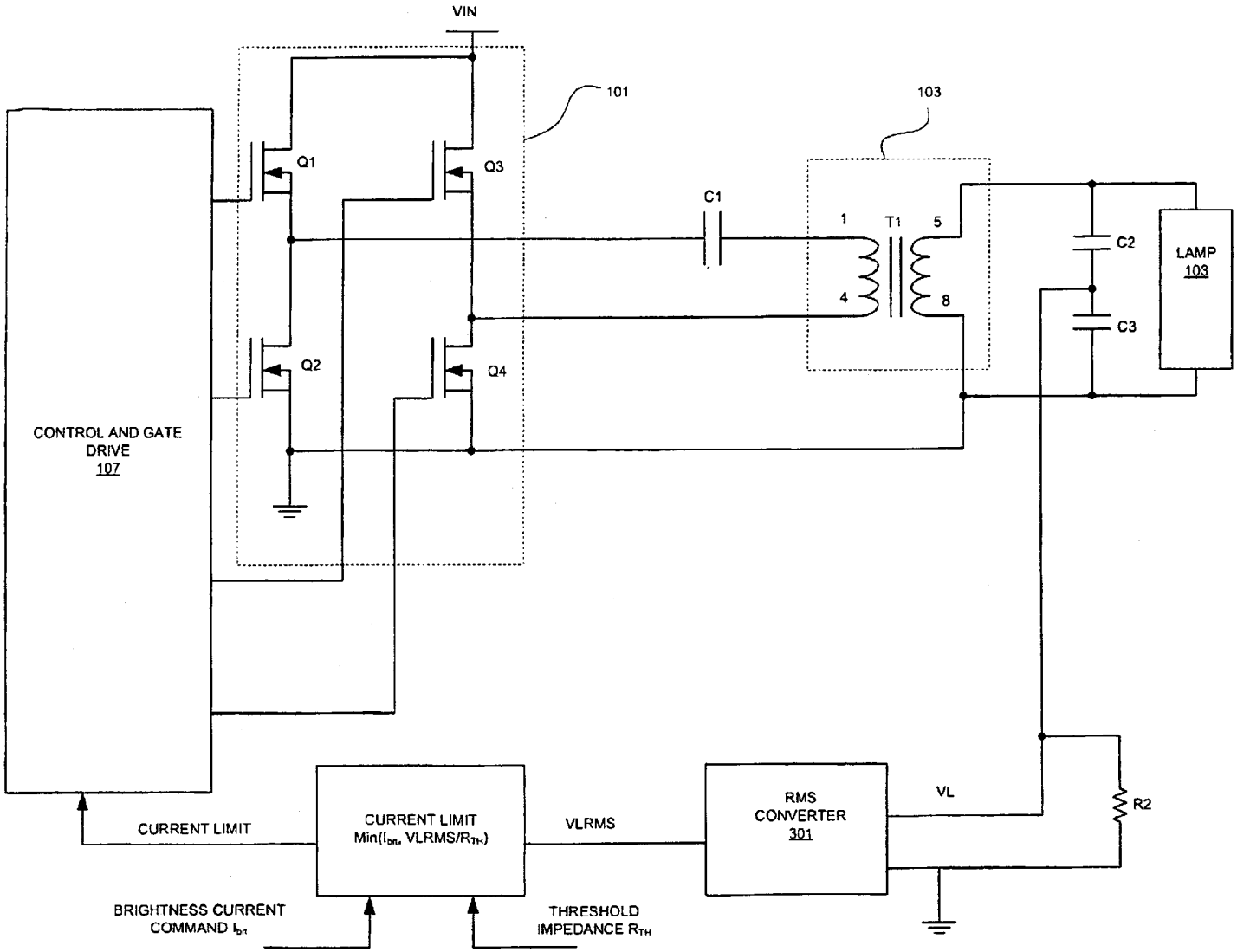
FIG. 3 is a schematic diagram showing a third embodiment of the present invention.
Figure 4:
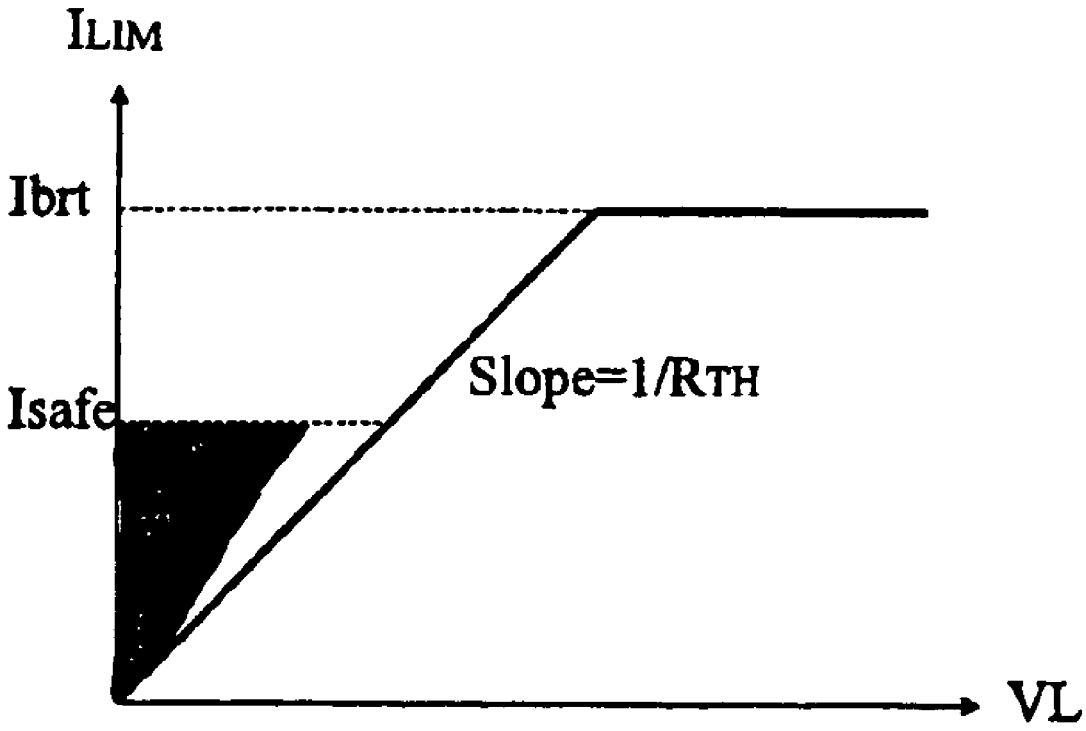
FIG. 4 is a graph showing current versus the voltage on the feedback node in accordance with the present invention.

FIG. 3 shows another implementation of the present invention. In this embodiment, $R_{TH}$ is set where $R_{TH}/(1+C3/C2)$ is between 2 kohm and the minimum lamp impedance. By choosing $R_{TH}/(1+C3/C2)$ higher than 2 kohm, it can be guaranteed that the short circuit current is lower than the safety current, as shown below. As seen in FIG. 3, a RMS converter 301 converts the feedback lamp voltage VL into a RMS value first and outputs a signal denoted VLRMS. Similar to FIG. 2, R2 is used to eliminate the dc bias in the feedback voltage VL. Note that the value of R2 is chosen to be significantly higher than the lamp impedance. Next, the short circuit analyzer 303 is used to output a current limit that is the minimum of $VL/R_{TH}$ and $I_{BRT}$. The resulting current limit is shown in FIG. 4. The heavy line is for normal operation current. The shaded area shows the LCC (Limited Circuit Current) protection region where VL may be smaller than $I_{SAFE}*R_{TH}$.

As long as $(1+C3/C2)*V_{TH}/I_{RMS}>=1.4*2$ Kohm, the circuit will guarantee that the short circuit current is always smaller than the safety current and the inverter operates properly with large lamp current which is greater than the safety current.

Note also that the short circuit current can be measured by a single resistor or capacitor in a fixed frequency inverter, and by the parallel combination of the resistor and capacitor in a variable frequency inverter.

The examples shown previously sense the voltage on the secondary side with a grounded sense. In other embodiments, the voltage and/or current may be sensed on the primary side. Still alternative, a differential sense scheme for floating drive inverters may be used. Furthermore, the teachings of the present invention may be used with other inverter topologies, including push-pull, half-bridge, etc.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

We claim:

1. A method of short circuit protection in a driver apparatus, the driver apparatus driving a lamp load through a transformer, the method comprising:

monitoring a feedback voltage on a load side of said transformer;

if said feedback voltage is higher than a preset threshold, continuing a normal operation; and if said feedback voltage continues to be lower than said preset threshold for at least one cycle, indicating a short circuit condition to said driver apparatus and limiting a current supplied by said driver apparatus to a safe current $I_{SAFE}$.

2. The method of claim 1 wherein said feedback voltage is monitored from a node between two series capacitors connected in parallel to said load and a secondary of said transformer.

3. The method of claim 1 wherein ISAFE is the root mean square of a normal operating current limit or the average rectified value of the normal operating current.

4. The method of claim 1 wherein said preset threshold is between 25 and 55 percent of normal operating voltage.

5. The method of claim 1 wherein said normal operation includes a brightness current command that is the upper limit for current.

6. The method of claim 1 wherein said indicating a short circuit condition further comprises issuing a logic signal to said driver apparatus, whenever said logic signal has a logic high, said short circuit condition exists, and whenever said logic signal has a logic low, said normal condition exists.

7. The method of claim 1 wherein said circuit condition further comprises monitoring whether said feedback voltage becomes negative in at least one cycle.

8. A method of short circuit protection in a driver apparatus, the driver apparatus driving a lamp load through a transformer, the method comprising:

monitoring a feedback voltage on a load side of said transformer;

determining the root mean square of said feedback voltage;

if said feedback voltage is higher than a preset threshold, continuing a normal operation; and if said feed back voltage continues to be lower than said threshold for at least one cycle, indicating a short circuit condition to said driver apparatus and limiting a current supplied by said driver apparatus to the minimum of either a brightness current limit or the root mean square of said feedback voltage divided by a threshold impedance $R_{TH}$.

9. The method of claim 8 wherein said feedback voltage is monitored from a node between two series capacitors connected in parallel to said load and a secondary of said transformer.

10. The method of claim 8 wherein said indicating a short circuit condition further comprises issuing a logic signal to said driver apparatus, whenever said logic signal has a logic high, said short circuit condition exists, and whenever said logic signal has a logic low, said normal condition exists.

11. An apparatus for driving a lamp load through a transformer comprising:

means for monitoring a feedback voltage on a load side of said transformer; and comparator means, electrically coupled to said monitoring means, for determining if said feedback voltage is higher than a preset threshold, said comparator means operable to continue a normal operation for said lamp load if said feedback voltage is higher than said preset threshold; if said feedback voltage continues to be lower than said preset threshold for at least one cycle, said comparator means operable to indicate a short circuit condition and limit a current supplied by said apparatus to said lamp load to a safe current $I_{SAFE}$.

12. The apparatus of claim 11 wherein said means for monitoring a feedback voltage receives as input a voltage on a node between two series capacitors connected in parallel to said lamp load and a secondary of said transformer.

13. The apparatus of claim 11 wherein said comparator means monitors said feedback voltage to determine if it is lower than said present threshold for at least one cycle, then limiting the current supplied to ISAFE.

14. The apparatus of claim 11 wherein ISAFE is the root mean square of a normal operating current limit or the average rectified value of the normal operating current.

15. The apparatus of claim 11 wherein said preset threshold is between 25 and 55 percent of normal operating voltage.

16. The apparatus of claim 11 wherein said normal operation includes a brightness current command that is the upper limit for current.

17. The apparatus of claim 11 wherein said comparator means further comprises an under voltage detection block electrically coupled to a logic block.

18. The apparatus of claim 17 wherein said logic block is operable to receive said logic signal indicating said short circuit condition from said under voltage detection block and operable to output a current limit.

19. The apparatus of claim 18 wherein logic signal comprises a high logic value indicating said short circuit condition and a low logic value indicating said normal condition.

20. The apparatus of claim 11 wherein said comparator means further comprises an RMS converter circuit, electrically coupled to said lamp load, operable to receive said feedback voltage and to convert said feedback voltage into a root means sguare value (RMS).

* * * * *